US012377454B2

(12) United States Patent
Artel et al.

(10) Patent No.: US 12,377,454 B2
(45) Date of Patent: Aug. 5, 2025

(54) DEVICE AND A METHOD FOR MACHINING AT LEAST ONE SURFACE OF A CONTINUOUS ALUMINUM OR AN ALUMINUM ALLOY STRIP

(71) Applicant: SMS group GmbH, Düsseldorf (DE)

(72) Inventors: Jens Artel, Kirchhundem (DE); Guido Fick, Kreuztal (DE); Olaf Norman Jepsen, Siegen (DE); Matthias Vogd, Düsseldorf (DE); Sebastian Böcking, Siegen (DE)

(73) Assignee: SMS group GmbH, Düsseldorf (DE)

( * ) Notice: Subject to any disclaimer, the term of this patent is extended or adjusted under 35 U.S.C. 154(b) by 0 days.

(21) Appl. No.: 18/579,329

(22) PCT Filed: Jun. 14, 2022

(86) PCT No.: PCT/EP2022/066144

§ 371 (c)(1),
(2) Date: Jan. 13, 2024

(87) PCT Pub. No.: WO2023/285056

PCT Pub. Date: Jan. 19, 2023

(65) Prior Publication Data

US 2024/0342778 A1 Oct. 17, 2024

(30) Foreign Application Priority Data

Jul. 14, 2021 (DE) ..... 10 2021 207 450.2.

(51) Int. Cl.
*B21B 45/06* (2006.01)
*B21B 3/00* (2006.01)

(52) U.S. Cl.
CPC ..... *B21B 45/06* (2013.01); *B21B 2003/001* (2013.01)

(58) Field of Classification Search
CPC ..... B21B 45/06; B21B 45/04; B21B 45/00; B21B 2003/001; B21B 3/00; B24D 13/00
See application file for complete search history.

(56) References Cited

U.S. PATENT DOCUMENTS 3,026,219 A * 3/1962 Peterson ..... B21B 45/00 134/9
3,239,276 A * 3/1966 Charvat ..... A46B 13/001 15/179

(Continued)

FOREIGN PATENT DOCUMENTS

DE 2440798 A1 3/1976
DE 19536820 A1 3/1997

(Continued)

*Primary Examiner* — Lawrence Averick
(74) *Attorney, Agent, or Firm* — Smartpat PLC

(57) ABSTRACT

The disclosure relates to a device (10) and a method for machining at least one surface of a continuous strip material (B) made of non-ferrous metals, which in particular comprises aluminum or aluminum alloys or consists of such materials. A rotating roller brush (12) is used, the roller length of which can be brought into contact with a surface of the strip material (B). Such roller brush (12) has a diameter of 200 mm to 1,000 mm and can rotate at a rotational speed of 100 to 3,600 rpm using an assigned motor drive (14).

15 Claims, 4 Drawing Sheets

(56) References Cited

U.S. PATENT DOCUMENTS

| | | | | |
|---|---|---|---|---|
| 7,500,298 | B2 * | 3/2009 | Love, III | B24C 1/086 29/81.09 |
| 8,312,917 | B2 * | 11/2012 | Schlichting | B22D 11/0622 164/428 |
| 8,366,842 | B2 * | 2/2013 | Sawada | B22D 11/181 75/686 |
| 2001/0047576 | A1 | 12/2001 | Love et al. | |
| 2005/0136811 | A1 * | 6/2005 | Love | B24C 1/086 451/102 |
| 2008/0011449 | A1 * | 1/2008 | Schlichting | B22D 11/0665 164/480 |
| 2012/0014834 | A1 * | 1/2012 | Sawada | B22D 11/0622 420/528 |

FOREIGN PATENT DOCUMENTS

| | | | |
|---|---|---|---|
| DE | 7111221 | U | 10/2007 |
| DE | 102009014006 | A1 | 9/2010 |
| JP | H10330974 | A | 12/1998 |
| WO | 0160568 | A1 | 8/2001 |
| WO | 2019209916 | A1 | 10/2019 |

* cited by examiner

DEVICE AND A METHOD FOR MACHINING AT LEAST ONE SURFACE OF A CONTINUOUS ALUMINUM OR AN ALUMINUM ALLOY STRIP

CROSS-REFERENCE TO RELATED APPLICATION

This application is a national stage application, filed under 35 U.S.C. § 371, of International Patent Application PCT/EP2022/066144, filed on Jun. 14, 2022, which claims the benefit of German Patent Application DE 10 2021 207 450.2, filed on July 14.

TECHNICAL FIELD

The disclosure relates to a device for machining at least one surface of a continuous strip material of non-ferrous metal, and to a corresponding method.

BACKGROUND

In the operation of strip casting lines (for example, hot rolling lines with roller ingot or strip casting machines), cast strips of non-ferrous (NF) metals, in particular aluminum or aluminum alloys, are generally hot rolled directly from the casting heat. In the event that the surfaces of the strip material are not further treated/cleaned, impurities that are introduced by the casting process can arise on the surface in a layer thickness of up to 50 μm. In the absence of separate cleaning measures, such impurities are rolled into the material in the subsequent rolling passes and can no longer be efficiently eliminated in later process stages. The impurities close to the surface have a detrimental effect on subsequent process stages and the surface quality features.

According to the prior art, it is known to process the surfaces of continuously cast strips made of non-ferrous metals and in particular of aluminum or aluminum alloys, for example abrasively, for example by using circumferential abrasive strips, which is known from DE 7111221 U. It is also known from DE 195 36 820 A1 to subject an aluminum casting strip to a continuous alternating bending load in order to break up the brittle surface layers of the casting strip. Both of the publications specified above have in common that, following the specified surface machining of the casting strip, rotating brushes that come into contact with the strip surfaces are used in order to eliminate the particles removed from the surfaces. Thereby, there is a disadvantage with regard to the rotating brushes that are used to clean the strip surfaces of chips or the like, to the effect that such chips can get stuck in the brushes/associated brush bristles. As a result, the efficiency for the desired cleaning of the surfaces of the NF strip is reduced.

It is known from DE 10 2009 014 006 A1 to clean the surface of a metal strip produced in a strip casting line by means of a brush roller rolling over the moving metal strip. Thereby, the contact pressure with which the brush roller is pressed against the surface of the metal strip is measured and, if necessary, modified appropriately. In this respect, the use of a brush roller is subject to the same disadvantages as already explained above for DE 7 111 221 U/DE 195 36 820 A1, because the cleaning efficiency on the surface of the metal strip generally deteriorates due to the build-up of dirt in the brush bristles/in the hairs of the brush roller.

Chemical cleaning processes, such as pickling, are not suitable for hot-cast rolled material.

SUMMARY

The disclosure explains how to optimize abrasive surface machining of non-ferrous metals, in particular in the form of aluminum strips, for cleaning purposes using technically simple means.

The above object is achieved by a device as disclosed and claimed, and in the same manner by a method as disclosed and claimed.

The disclosure provides a device for machining at least one surface of a continuous strip material made of non-ferrous metals, which in particular comprises aluminum or aluminum alloys or consists of such materials. The device comprises at least one rotating roller brush, the roller length of which can be brought into contact with at least one surface of the strip material. This roller brush has a diameter of 200 mm to 1000 mm. Preferably, the diameter of this roller brush can be between 200 and 500 mm, more preferably between 250 and 400 mm.

In the same manner, the disclosure also provides a method for machining at least one surface of a continuous strip material made of non-ferrous metals, with which the strip material is moved in a strip running direction and at least one rotating roller brush with its roller length is brought into contact with at least one surface of the strip material and is driven by a motor drive. The rotating roller brush rotates at a rotational speed of 100 to 3,600 rpm due to the motor drive. Preferably, the rotating roller brush is set in rotation by the motor drive at a rotational speed of 1,200 to 1,800 rpm.

In an advantageous further development of the device, a motor drive, which is operatively connected to the rotating roller brush and drives it about an associated axis of rotation, is provided for this purpose. This motor drive is connected to a control device by means of signals. The control device is programmatically configured in such a manner that the rotating roller brush can rotate at a rotational speed of 100 to 3,600 rpm. Preferably, the rotating roller brush can rotate/can be set in rotation at a rotational speed of 1,200 to 1,800 rpm by means of the motor drive and the control device connected to it by means of signals.

In accordance with an advantageous further development, it is possible for a gearbox to be arranged/interposed between the motor drive and the rotating roller brush. By using such a gearbox, it is possible to achieve a reduction or a translation in the rotational speed of the motor drive in the direction of the rotating roller brush and thus the specified values for the resulting rotational speed of the rotating roller brush.

At this point, it is pointed out separately that the "surface of the strip material" feature refers to such a surface that comes into contact with rollers in the further course of machining the strip material/is rolled in a rolling mill. In this respect, it is understood that the use/arrangement of the rotating roller brush(es) is effected in such a manner that a near-surface layer is removed/eliminated from the strip material immediately after the casting process and thus before the first rolling pass. This prevents unwanted impurities, for example in the form of casting powder inclusions, from being rolled into the strip material. In the same manner, surface defects, such as those caused by indentation marks from the casting process, for example joint marks, are eliminated by removing the layer close to the surface. The removal of chemical deviations/irregularities in the near-surface layer of the strip material, such as oxides, is also possible. Within the framework of this description, only the term surface machining or cleaning is used, wherein the removal of indentation marks and the removal of chemical surface deviations/irregularities are equally included.

In this connection, it is pointed out separately that, by using at least one rotating roller brush, it is possible to brush a upper side and/or a lower side of the strip material and/or also to brush the upper side/the lower side of the strip material several times/"twice" by means of roller brushes arranged/connected in series.

Furthermore, it is pointed out separately that, in the event that the strip material to be machined consists of aluminum or aluminum alloys, the "aluminum strip" feature refers to aluminum strips of all alloy groups 1xxx, 2xxx, 3xxx, 4xxx, 5xxx, 6xxx, 7xxx and 8xxx according to the AA grouping (Aluminum Association Alloy Codes).

The present disclosure is based on the finding that, by means of the specified diameter of the roller brush, which can lie in the range from 200 mm to 1000 mm/the characteristic rotational speed of 100 to 3,600 $min^{-1}$, with which such rotating roller brush is driven about its axis of rotation, it is achieved that the brushes/hairs on the outer circumference of the roller brush are subjected to a sufficiently high centrifugal force, and thus dirt/impurities brushed off the strip surface, which initially get stuck on the outer circumference of the rotating roller brush/its bristles, are then effectively ejected outwards. The result is an advantageous self-cleaning for the rotating roller brush, which is accompanied by both an improvement in the surface quality of the machined strip material and an extension of the service life of the roller brush.

By means of the abrasive treatment of the surface(s) of the strip material by at least one rotating roller brush, both surface impurities and any geometric defects present are eliminated from the strip material in a joint machining step.

In an advantageous further development, the roller brush has a diameter of 200-500 mm, preferably 250-400 mm. With such a diameter, it is advantageous that the roller brush is sufficiently designed to be compact, on the one hand, in order to achieve targeted localized machining of the surface of the strip material and, on the other hand, the brushes/hairs on the outer edge of the roller brush are subjected to a sufficiently high centrifugal force, as explained above, so that dirt is ejected radially outwards from the brushes.

By means of a rotating roller brush, it is possible to abrasively remove a layer with a thickness of up to 500 μm from at least one surface of a strip material made of non-ferrous metal. Technologically, the removed layer thickness is preferably in the range of 1 μm to 200 μm. Such removal can be global or partial. In any event, abrasive machining of at least one surface of the strip material by means of brushes has the advantage that it enables a variable layer thickness to be removed, which has no influence on the machining quality and thus on the appearance of the surface of the strip material.

In an advantageous further development, the targeted machining of the strip material on at least one surface thereof can be improved by the fact that the rotating roller brush, which is brought into contact with such surface, can be moved not only rotationally about its axis of rotation, but also relative to the strip running direction of the strip material. With respect to such movability of the roller brush, it is possible for it to be arranged so that it can move back and forth translatory transversely to the strip running direction of the strip material. In addition or as an alternative, it is also possible for the rotating roller brush to be arranged so that it can move back and forth translatory parallel to the strip running direction of the strip material.

The rotating roller brush can be arranged movably transverse to the strip running direction (or the strip casting direction), wherein it is moved in an oscillating manner (i.e., back and forth) with an amplitude of 5 to 200 mm and a frequency between 0.005 and 5 Hz. Preferably, the amplitude can also be in the range of 5-100 mm, wherein the frequency can preferably be between 0.01 Hz and 0.5 Hz.

An electric or hydraulic drive can be provided as an oscillation drive for moving the rotating roller brush transverse to the strip running direction. The setting/selection of the oscillation frequency depends on the state of the roller brush and/or the bristles selected for this purpose.

By moving the rotating roller brush in translatory manner transversely to the strip running direction, even more intensive abrasive machining is achieved on at least one surface of the strip material with which the roller brush comes into contact.

As already said above, according to an advantageous further development, it can additionally or alternatively be provided that the rotating roller brush is also arranged so as to be movable back and forth in translation parallel to the strip running direction/is moved back and forth parallel to the strip running direction. In such a case, the roller brush can be oscillated during rotation about its axis of rotation with an amplitude of 10 to 200 mm and a frequency of between 0.2 and 5 Hz, in translation parallel to the strip running direction (i.e., in the strip running direction or in the opposite direction). An electric or hydraulic drive can be used to move the rotating roller brush back and forth. With the aid of such a drive, it is also possible to variably set a traversing speed at which the rotating roller brush is moved parallel to the strip running direction.

If the rotating roller brush is moved in translation in the strip running direction of the strip material and thus "travels along" with the moving strip material, preferably at the same speed as the strip material, this achieves the advantage that the same spot of the strip material, during which it is moved in the strip running direction, is then machined abrasively by means of the rotating roller brush. In other words, the same spot of the strip material is machined abrasively by the rotating roller brush for a predetermined dwell time, wherein such dwell time corresponds to the period of time during which the rotating roller brush is moved in translation in the strip running direction. As already explained, the translational movement of the roller brush in the strip running direction preferably has the same speed as the strip material itself. This intensifies the removal of material from the surface of the strip material/the machining of the strip material at the same spot can be intensified by the rotating roller brush.

In an advantageous further development, it can be provided that the rotating roller brush is arranged on one side of the strip material, wherein a support roller in contact with the strip material is arranged on an opposite side of the strip material and in alignment with the roller brush. With the aid of such a support roller, it is possible for the roller brush to be pressed against/onto the strip material with a predetermined force at the same time as it rotates about its axis of rotation, without the strip material thereby being deformed in the direction of the applied force.

In accordance with an advantageous further development, it can be provided that rotating roller brushes are arranged on both sides of the strip material. This means that such rotating roller brushes are arranged on both sides of a strip material, i.e. on opposite sides of it. In such a case, both surfaces of the strip material are machined by means of the rotating roller brushes. In this connection, it should be pointed out that the roller brushes, which are provided on the opposite sides of the strip material, can be arranged directly above one another/in alignment with one another, which ensures an optimum flow of force. Alternatively, it is also possible for the roller brushes on the opposite sides of the strip material to be arranged in a manner offset to one another, as a result of which it is possible, for example, to take into account joint marks that can occur during the production of strip material using a strip casting machine with a mold (block caster) that travels along.

In an advantageous further development, a plurality of rotating roller brushes can be arranged one behind the other along a strip running direction of the strip material and on the same side thereof. This achieves redundancy in terms of process technology in the sense that the same spot on/at a surface of the strip material is repeatedly abrasively machined by a rotating roller brush. This can be used to rectify any serious surface defects that may be present on a strip surface. It is possible that such roller brushes are in each case equipped with their own motor drive and height adjustment device.

In the event that two or more roller brushes act in succession on a surface of the strip material, the respective roller brushes can be divided into segments. With a continuous brush roll, regions with bristles alternate with regions without bristles. This allows precise width sections to be set depending on the position/lifting of the roller brushes. An even more precise setting of the surface machining for the strip material is possible if a roller brush is segmented in such a manner that a plurality of shorter individual brush rollers are not only arranged one behind the other in the strip running direction, but also across the strip width. Due to the option of individually adjusting the shorter sub-brushes, a surface defect in the strip material can be rectified with pinpoint accuracy. Similarly, individual adjustment allows more precise adjustment to the existing profile of the strip material to be machined.

In an advantageous further development, it can be provided that a cleaning device is provided adjacent to each rotating roller brush and on the same side of the strip material, by means of which a surface of the strip material with which the rotating roller brush is in contact can be cleaned. By means of such cleaning device, compressed air can be generated on the adjacent surface of the strip material and/or negative pressure can be generated adjacent to the surface of the strip material by means of suction. This ensures that dirt, chips or the like, which have been removed from the surface of the strip material by means of the rotating roller brush, are subsequently effectively eliminated from the surface of the strip material. This prevents such dirt or the like from being rolled into the surface of the strip material during a subsequent rolling pass.

If compressed air is used in the cleaning device specified above, which is directed onto the adjacent surface of the strip material, it is expedient that such a blowing off of the strip surface takes place transversely to the strip running direction, i.e. in the width direction of the strip material. This also ensures that dirt particles or similar impurities on the surface of the strip material are intensively eliminated without leaving any residue and are therefore not rolled in again in a subsequent hot rolling step.

In an advantageous further development, the cleaning device specified above can have a housing with an inlet region and an outlet region. Thereby, it is expedient if the strip material is moved through the housing from the inlet region in the direction of the outlet region along a strip running direction, wherein the housing is shielded from the surrounding area. This means that the interior of the housing is suitably shielded from the surrounding area and protected against the ingress of external dirt or the like.

In special cases, the housing of the cleaning device can be filled with an inert gas or at least enriched with such an inert gas.

In an advantageous further development, it can be provided that the cleaning device specified above and the rotating roller brush are combined to form a single unit, wherein the rotating roller brush is received in an encapsulated manner within the housing of the cleaning device. As already explained, the interior of the housing of the cleaning device can be subjected to negative pressure, as a result of which air and in particular abrasion and dirt particles, which are produced by the rotating contact of the roller brush with at least one surface of the strip material and are contained in the interior, are suitably extracted and taken away. In this respect, it is possible to feed the air and the dirt particles contained therein, which are extracted from the interior of the housing of the cleaning device, to a subsequent treatment process.

The encapsulation explained above of the rotating roller brush within the housing of the cleaning device serves not only to protect the surrounding area and operating personnel, but also to prevent the redeposition of dirt particles/impurities on a surface of the strip material. This ensures that such dirt particles/impurities are not rolled into the surface(s) of the strip material during a subsequent rolling pass.

In an advantageous further development, an internal cooling system can be provided for the rotating roller brush. This makes it possible to protect the bristles and the brush body against overheating due to permanent heat load.

In an advantageous further development, a surface inspection device is provided, which is arranged upstream of the rotating roller brush-viewed in the strip running direction of the strip material- and comprises a strip tracking system with a defect detection device and a control device. By means of the defect detection device, the type and location/position of surface defects on the surface of the strip material with which the rotating roller brush comes into contact can be detected, wherein the rotating roller brush is controlled by means of the control device as a function of such information. Such a surface inspection device can be provided both for the device and for the method.

By means of the defect detection device, surface defects in the strip material, specifically in terms of the type and location/position of such surface defects, can be detected. As a function of such information, the roller brush can preferably be adjusted/controlled in a controlled manner, specifically with regard to its rotational speed, the contact pressure against the surface of the strip material, the translatory movement transverse to the strip running direction and/or the translatory movement parallel to the strip running direction.

Accordingly, in accordance with an advantageous further development of the method, it is provided that, in the course of the control of the rotating roller brush(es), their rotational speed, a contact pressure against the strip material, a translatory movement transverse to the strip running direction of the strip material and/or a translatory movement in the strip running direction of the strip material and thus also a relative speed between the rotating roller brush and the strip material transverse to the strip running direction and/or in the strip running direction are set/changed. As already explained, in each case this can be effected as a function of the surface defects that are recognized/detected by means of the defect detection device on a surface of the strip material, possibly also in the form of a control system.

The defect detection device expediently comprises a tactile sensor and/or an optical sensor/a camera that is aligned with a surface/surfaces of the strip material.

With the aid of the strip tracking system and the associated control device, it is possible to assign the surface defects detected by the defect detection device to an exact spot/position on the surface of the strip material, both with regard to a width direction of the strip material and in the direction of its longitudinal extension.

The operation of the device/the carrying out of the method can be provided in such a manner that the brushing intensity is controlled as a function of the measured defect (or the measured defects), specifically taking into account the location of the detected defect and/or the size of the defect and/or the periodicity of the defect. Thereby, the setting parameters of the roller brush described above can be used to set the brushing intensity.

At this point, it is pointed out separately that a defect detection device, by means of which defects present on/at a surface of the strip material can be detected as explained, can be arranged on an upper side of the strip material (i.e., above it) and/or on a lower side of the strip material (i.e., below it). A rotating roller brush is then arranged in each case at the upper side/lower side of the strip material in association with such a defect detection device. If rotating roller brushes are arranged on both sides of the strip material, i.e. on its upper and lower sides, for the purpose of cleaning both the upper side and the lower side of the strip material, such rotating roller brushes can be controlled either jointly or individually with regard to their movement parameters.

With regard to the composition of the brushes/hairs of the roller brush, the following features are considered:

- The brushes can be made of preferably hardened stainless steel; and/or:
- The brushes can be designed to be either wavy or straight; and/or:

The tensile strength of the individual bristles/hairs of the bristles is >200 MPa/mm$^2$, and preferably >800 MPa/mm$^2$.

The possible composition of the brushes/hairs of the rotating roller brush made of stainless steel has the advantage that the roller brush and its bristles are corrosion-resistant.

The following parameters may also be relevant for the method, which may affect the operating parameters of the roller brush to be set:

- The casting speed is between 1 and 300 m/min. And/or:
- The casting strip thickness is between 2 mm and 30 mm. And/or:
- The temperature of the strip material during machining is between 12° and 600° C. or—depending on the material of the cast strip material—40 to 300° C. below the liquidus temperature. And/or:
- The relative speed between the strip material on the one hand and the rotating roller brush on the other hand is between 10 and 300 m/s. And/or:
- The material of the casting strip has a high-temperature strength/yield point of between 5 and 200 MPa.

The present invention is suitable for machining the surfaces of non-ferrous metals in order to effectively eliminate impurities caused, for example, by a casting release agent. Such an elimination/partial removal of the surface layer of a strip material consisting of an non-ferrous metal is effected prior to the first rolling pass. This has the advantage that impurities are not even rolled into the material when rolling a strip material consisting of such non-ferrous metals. In other words, the present invention prevents unwanted impurities resulting from the casting process from being rolled into the material/into the surface(s) of the strip material. As a result, the surface appearance of the finished end products is improved with the aid of the present invention, for example with regard to the evenness and gloss of the surfaces.

For the device according to the invention, it is provided that it is located with its rotating roller brush in a strip casting line between the casting device and an adjoining rolling device. In this connection, it is pointed out that the device can also be installed subsequently, i.e. retrofitted, in an existing strip casting line.

By means of the present invention, significant improvements with regard to the surface quality of a hot-rolled strip material made of non-ferrous metals are achieved. In subsequent process stages, such as cold rolling, pickling and/or coating, this results in advantages in terms of the required process parameters and the quality that can be achieved, along with a more uniform surface appearance, i.e. on/in the region of the surface(s) of the strip material.

Further details and advantages of the invention are shown in the following exemplary embodiments, which are explained with reference to the figures.

DETAILED DESCRIPTION

Figure 1:
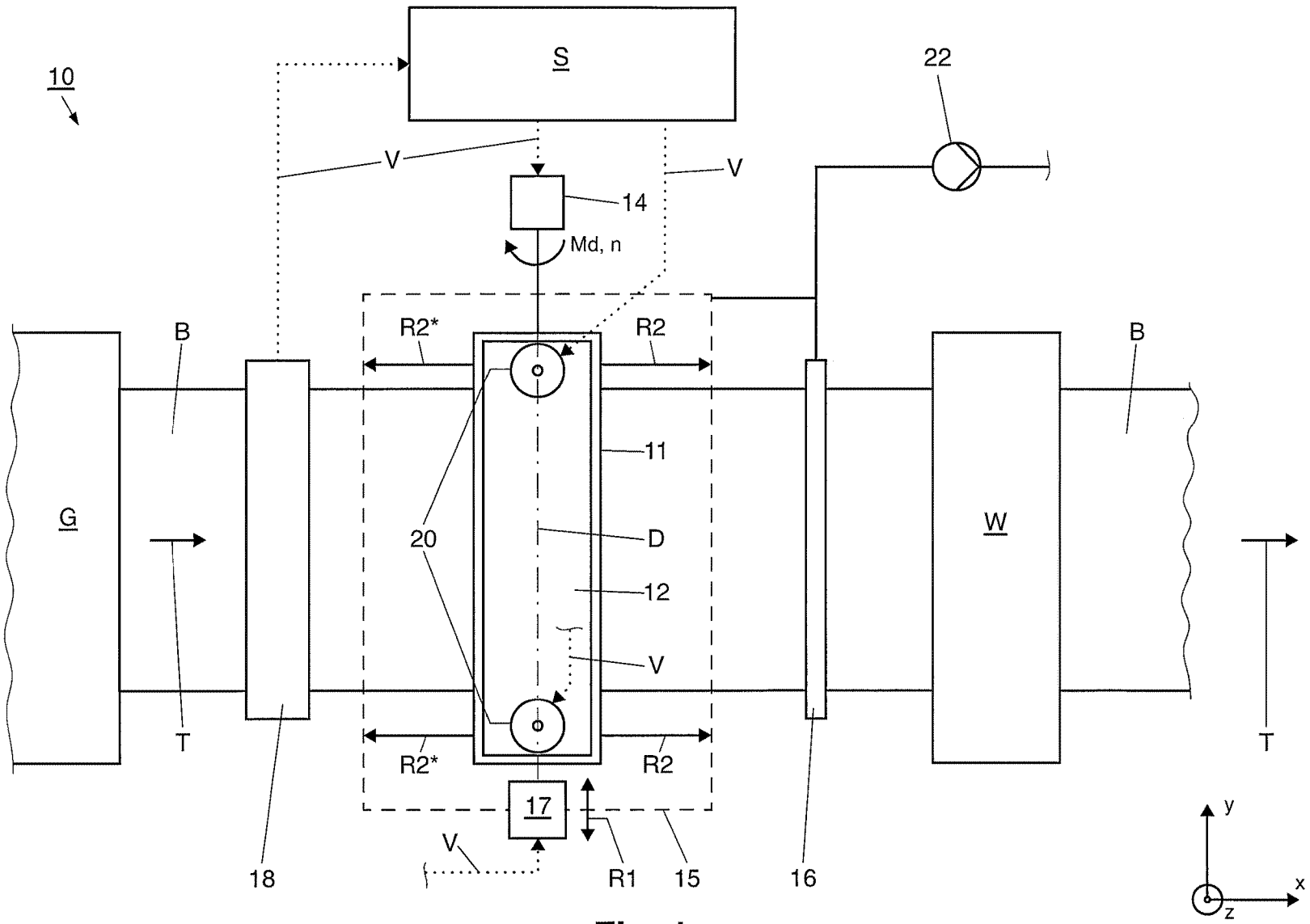
FIG. 1 is a simplified view of a device for machining continuous strip material.
Figure 2A:
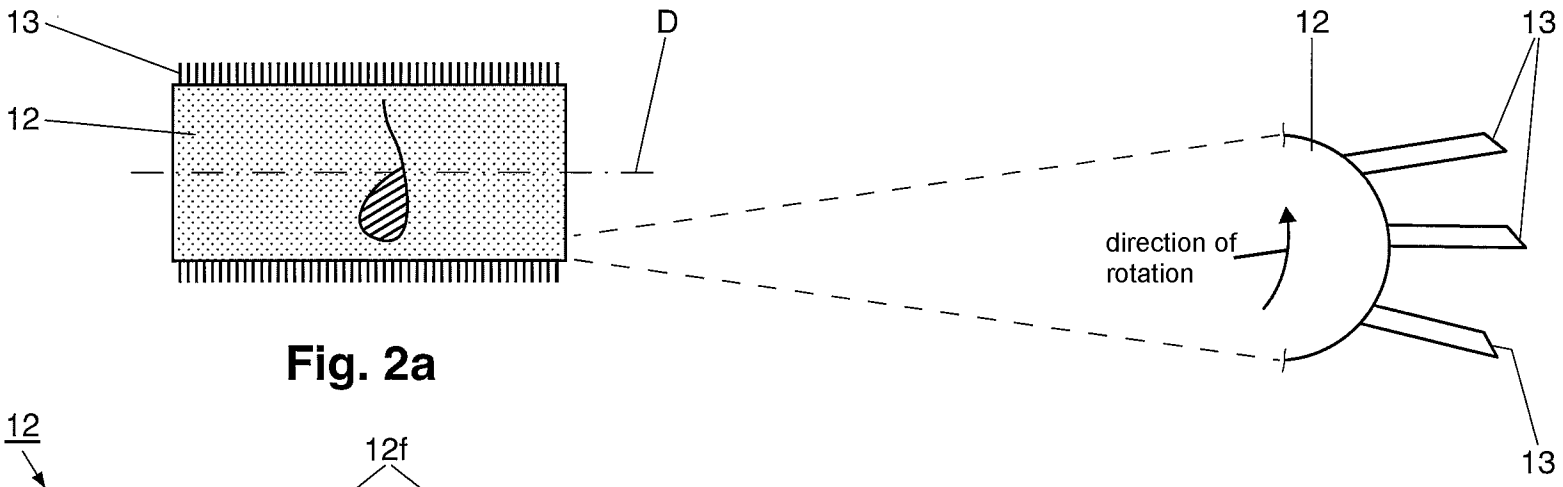
FIG. 2*a* is a simplified side view of a roller brush, which can be part of the device of FIG. 1 and is continuously covered with bristles.
Figure 2B:
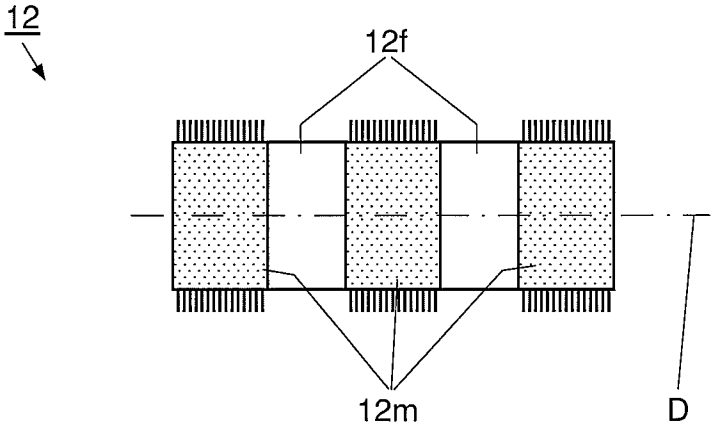
FIG. 2*b* a simplified side view of a roller brush, which can be part of the device of FIG. 1 and is covered with bristles in segments.
Figure 2C:
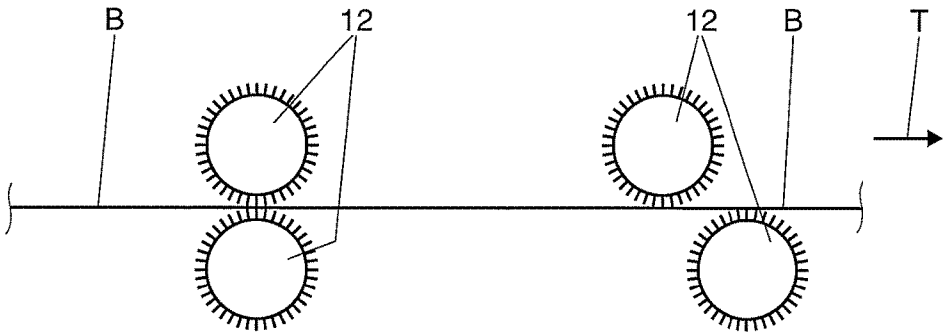
FIG. 2*c* shows a possible embodiment of the device of FIG. 1, with which rotating roller brushes are arranged in each case above and below a strip material.
Figure 2D:
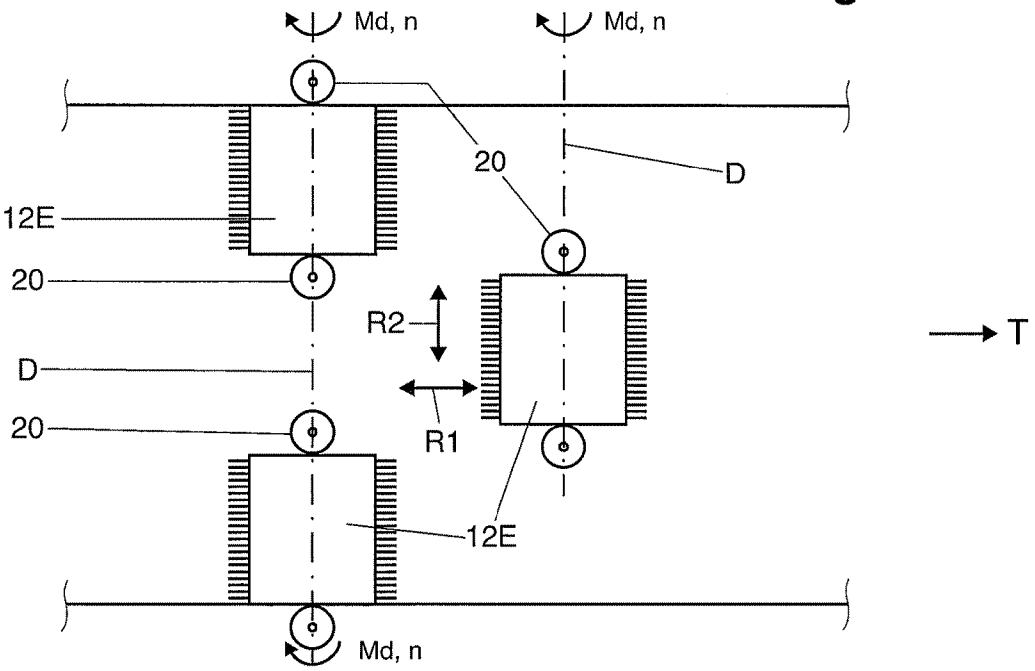
FIG. 2*d* is a top view of a strip material for a possible embodiment of the device of FIG. 1, with which a plurality of roller brushes—viewed in the strip running direction of the strip material—are arranged one behind the other.
Figure 3:
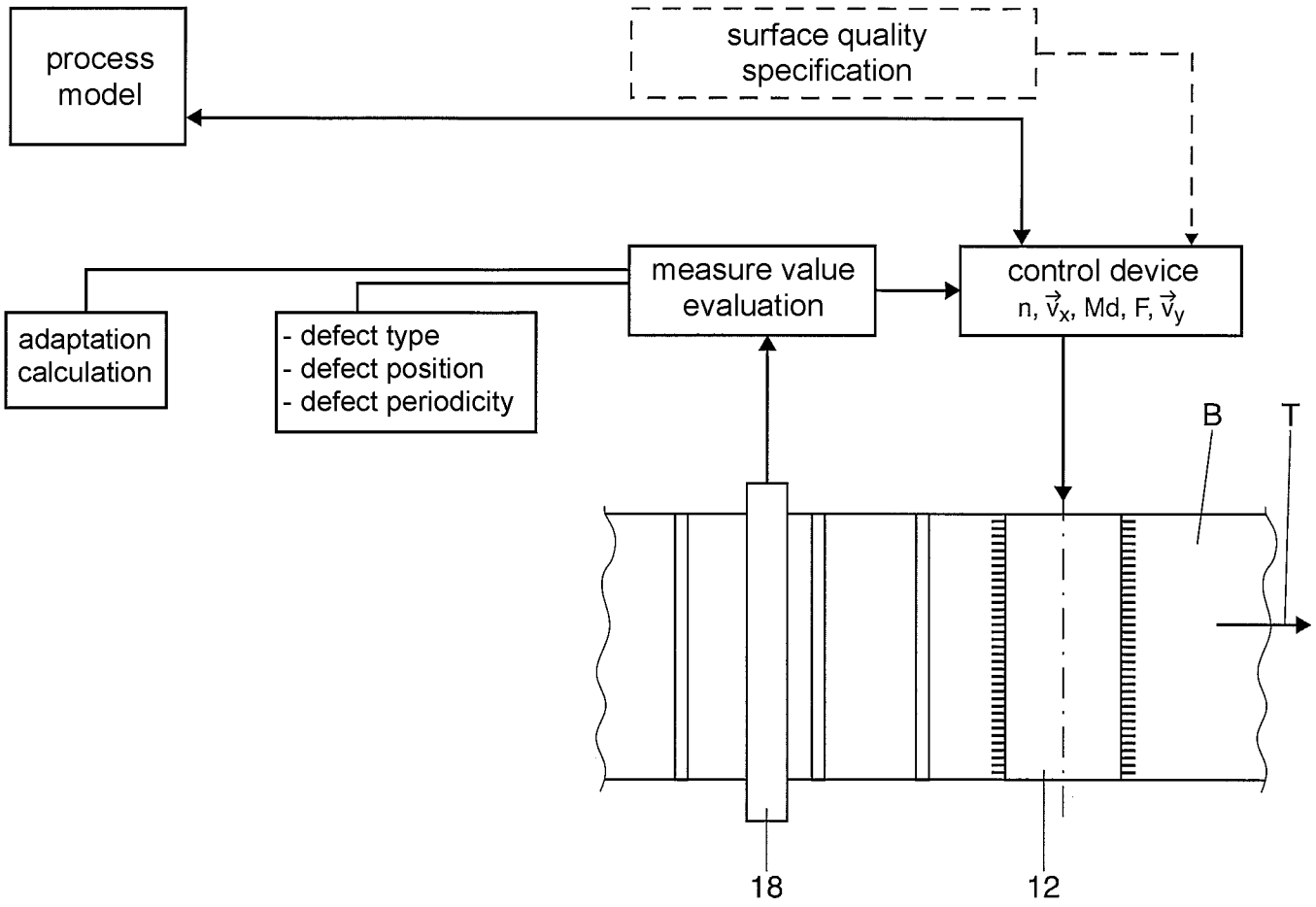
FIG. 3 shows a diagram for a control system of the device of FIG. 1.

With reference to FIGS. 1-3, preferred embodiments of a device 10 and an associated method for machining at least one surface of a continuous strip material made of non-ferrous metals are shown and explained below. Identical features in the drawing are in each case marked with the same reference signs. At this point, it is separately pointed out that the drawing is only simplified and in particular shown without scale.

The non-ferrous metal strip material, at least one surface of which is machined by means of the present invention, can in particular consist of aluminum or aluminum alloy(s). Alternatively, it is also possible to machine a strip material made of other non-ferrous metals, such as copper, magnesium, lead or zinc/their alloys.

The device 10 comprises at least one rotating roller brush 12, with which a strip material B, which is moved/transported in a strip running direction T, is cleaned. In the view in FIG. 1, the strip runs from left to right and is symbolized by corresponding arrows T.

Within a strip casting line, which is not necessarily part of the present invention, the device 10 is positioned in such a manner that—viewed in the strip running direction T—it is arranged downstream of a casting line G and upstream of a hot rolling line W and an associated rolling mill stand.

The view in FIG. 1 can be a top view of the strip material B, either from its upper side and/or from its lower side. This means that a rotating roller brush 12 can be arranged in each case on the upper side of the strip material B and/or on its lower side. In other words, the device 10 can comprise at least one rotating roller brush 12 arranged either on the upper side or on the lower side of the strip material B. Alternatively, the device 12 of FIG. 1 can also comprise a plurality of roller brushes 12, which are arranged on both sides of the strip material, i.e. on the upper side and on the lower side of the strip material B.

For the following explanation of the mode of operation of the device and the associated method, it is irrelevant whether the view of FIG. 1 is a top view of the upper side of the strip material B or a view of its lower side—the mode of operation of the rotating roller brush 12 and its movements is the same in each case.

With the embodiment shown in FIG. 1, the roller length/longitudinal extension of the roller brush 12 is greater than the width of the strip material B. As a result, the entire width of the strip material B is machined abrasively by the rotating roller brush 12 if it is brought into contact with a surface of the strip material B with its roller length.

The device 10 comprises at least one motor drive 14, which is operatively connected to the rotating roller brush 12 and drives it about an axis of rotation. In the drawing (see FIG. 1, FIG. 2*a*, FIG. 2*b*, FIG. 2*d*), such axis of rotation is indicated in each case by a dashdotted line and designated "D."

A motor drive 14 can be arranged on one side of the rotating roller brush 12, to the left or right of the strip material B. Alternatively, two motor drives 14 can also be provided, in each case on opposite sides of the strip material B, wherein such drives 14 in each case interact with the roller brush 12 and drive it about its axis of rotation D. The provision of two motor drives 14 per roller brush 12 is particularly advantageous if such a roller brush 12 has a large width and in this respect is driven from both end faces.

The motor drive 14 is connected to a control device S by means of signals. This connection by means of signals is symbolized in FIG. 1 by a dotted line and designated "V." The specifications "Md" and "n" designate, on the one hand, the torque and, on the other hand, the rotational speed with which the roller brush 12 is rotationally driven about its axis of rotation D. The direction of rotation can be selected both in and against the strip running direction, wherein the direction of rotation against the strip running direction is preferred due to the higher efficiency.

As already explained elsewhere above, the roller brush 12 is designed in such a manner that its diameter is 200 mm to 1000 mm. Furthermore, the control device S is programmatically configured in such a manner that the rotating roller brush 12, driven by the motor drive 14, can rotate at a rotational speed of 100 to 3,600 $min^{-1}$, possibly also using a gearbox (not shown), which is arranged between the motor drive 14 and the rotating roller brush 12.

A roller brush 12 can not only be set in rotation about its axis of rotation D, but can also be moved relative to the strip material B in the directions x, y and z. Such Cartesian coordinate system is symbolized in the bottom right of FIG. 1. For the relative movement in the y-direction, for example, an oscillation drive 17 is provided, which is only shown symbolically in FIG. 1 for the sake of simplicity.

The possible movements of the roller brush 12 in the directions x, y and z are achieved with the aid of a frame, which is shown in FIG. 1 in a very simplified form and symbolically only with a rectangle and designated "11." The following explanations are provided below:

The roller brush 12 is rotatably mounted in the frame 11. Such frame 11 receives bearing shells (not shown), with/in which the roller brush 12 is mounted so that it can rotate about its axis of rotation D. The operative connection to the motor drive 14, with which the roller brush 12 is driven about its axis of rotation D, can be realized on the end face of the roller brush 12 by a drive shaft or the like.

The frame 11 for mounting a roller brush 12 also comprises vertical bars along which the bearing shells for the roller brush 12 are movably mounted. The bearing shells are connected to adjusting elements 20, preferably in the form of hydraulic cylinders, with which the bearing shells can be moved along the vertical bars. In this manner, the roller brush 12 can be adjusted in the vertical direction z in order to set on a targeted basis a height/a distance between the roller brush 12 and the strip material B.

At this point, it is pointed out separately that a connection V by means of signals can also exist between the control device S, on the one hand, and the oscillation drive 17 and the adjusting elements 20, on the other hand. On the basis of this, it is possible to control the oscillation drive 17 and the adjusting elements 20 by means of the control device S. In FIG. 1, such connections V by means of signals are also symbolized with dotted lines.

By means of the specified adjusting elements 20, it is also possible to exert a targeted contact force on the roller brush 12, with which the roller brush 12 is pressed against the strip material B. For example, the contact force can be 0.1 to 2.8 N/mm brush width. In any event, the contact pressure can be set for the roller brush 12, adjusting the alloy of the material to be cleaned. The setting of the adjusting elements 20 is effected using the signals of the control device S.

With regard to the movable mounting of the roller brush 12 on the specified vertical bars, it is understood that this also makes it possible to lift the roller brush 12 from the surface of the strip material B if required.

As already explained, the oscillation drive 17 is provided on the frame 11, with which the bearing shells for the roller brush 12, and thus also the roller brush 12 itself, can be moved in the width direction of the strip material B, i.e. in the y-direction. Such oscillation drive 17 can be designed as a hydraulic cylinder or as a motor drive and can also be connected to the control device S by means of signals. Accordingly, such oscillation drive 17 can be suitably controlled by the control device S, for example in such a manner that the bearing shells for the roller brush 12, and thus also the roller brush 12 itself, are oscillated in the y-direction, i.e. moved back and forth in translation.

The directions (in the y-direction) in which the roller brush 12 can be moved in an oscillating manner transversely to the strip running direction T, as explained above, are also symbolized by the double arrow R1 in FIG. 1.

The frame 11 also comprises a rail system (not shown) on/at which the roller brush 12 together with its bearing shells can be moved in translation parallel to the strip running direction T (or in the x-direction). A movement in the strip running direction T is symbolized in FIG. 1 by the arrow "R2," while movement in the opposite direction, i.e. against the strip running direction T, is symbolized in FIG. 1 by the arrow "R2*." To realize such a back and forth movement of the roller brush 12 parallel to the strip running direction T, a further hydraulic cylinder (not shown) or a comparable motorized linear drive is provided, which is operatively connected either to the bearing shells of the roller brush 12 or to the entire frame 11. Expediently, this hydraulic cylinder/drive is also connected to the control device S by means of signals, such that control by means of the control device S is possible to realize a movement/displacement of the roller brush(es) 12 parallel to the strip running direction T.

The translatory back and forth movement of the roller brush 12 in the directions R2 and R2*, i.e. back and forth parallel to the strip running direction T, can also take place in an oscillating manner. It can be provided that the speeds for the directions R2 (i.e., in the strip running direction T) and R2* (i.e., against the strip running direction T) differ from one another/are set to different values by means of the control device S.

In connection with the oscillating movements that, as explained above, can be set for the roller brush 12 transversely to the strip running direction T (=y-direction/R1) and parallel to the strip running direction (=x-direction/in the directions R2 and R2*), it is understood that such movements can be superimposed with the rotational movement/rotation of the roller brush 12 about the axis of rotation D. This means that the roller brush 12 can also be moved in the directions R1 and R2/R2* at the same time as it rotates around the axis of rotation D.

With the embodiment shown in FIG. 1, the device 10 comprises a housing 15 in which the rotating roller brush 12 is received in an encapsulated manner. Accordingly, the rotating roller brush 12 is shielded from the surrounding area by the housing 15.

The housing 15 has an inlet region and an outlet region, wherein the strip material B is moved through the housing 15 from the inlet region in the direction of the outlet region along the strip running direction T.

The housing 15 is connected to an extraction device 22, with which air and the dirt particles and comparable impurities contained therein are extracted/removed from the interior of the housing 15.

The device 10 comprises a cleaning device 16, which is arranged adjacent to the rotating roller brush 12 and on the same side of the strip material B as the roller brush 12. By means of such cleaning device 16, a surface of the strip material B with which the rotating roller brush 12 has previously come into contact can be cleaned. This can be achieved, for example, by the cleaning device 16 also being connected to the extraction device 22, thereby generating negative pressure with which dirt particles and similar impurities are extracted from the surface (or the surfaces) of the strip material B.

Additionally or alternatively, with regard to the cleaning device 16, it can be provided that compressed air is hereby directed onto at least one surface of the strip material B, preferably in a direction transverse to the strip running direction T. The surface of the strip material B is then intensively cleaned by applying such compressed air. In such a case, the unit "22" can be a blower with which such compressed air is generated and fed into the cleaning device 16.

The application of compressed air in/with the cleaning device 16 to at least one surface of the strip material B can also be superimposed with the suction of air specified above. In the interior of the housing 15/the cleaning device 16, compressed air is directed on a targeted basis onto the surface of the strip material B that has previously come into contact with the rotating roller brush 12 and has been abrasively machined as a result. At the same time or following this, air is extracted from the interior of the housing 15/the cleaning device 16 in order to suitably eliminate the dirt particles/impurities contained therein.

According to a preferred further development of the device 10, it is expedient if the cleaning device 16 and the housing 15, in which the rotating roller brush 12 is received in an encapsulated manner, are integrated/combined to form a structural unit. In such a case, it is understood that the housing 15 shown in the illustration in FIG. 1 is that of the cleaning device 16.

Even in the case of the integration specified above of a cleaning device 16 with the housing 15, it can be provided that-viewed in the strip running direction T—an additional cleaning device 16 is provided downstream of the rotating roller brush 12, as shown in FIG. 1

The device 10 also comprises a surface inspection device 18, which-viewed in the strip running direction T—is provided upstream of the rotating roller brush 12. This surface inspection device 18 has a defect detection device (not specifically designated), for example in the form of an optical sensor or a camera, with which defects/flaws on/at the surface of the strip material B can be detected. In this respect, it is understood that the defect detection device is positioned on the same side of the strip material B as the rotating roller brush 12, which comes into contact with the surface of the strip material B on this side.

With one embodiment of the device 10, with which rotating roller brushes 12 are arranged both on the upper side and on the lower side of the strip material B (see FIG. 2*c*), it is expedient for separate defect detection devices to be arranged in the same manner on the upper side and on the lower side of the strip material B, such that possible defects in the strip material B can be detected on both sides thereof.

The defect detection device referred to above is part of a strip tracking system, which is part of the surface inspection device 18, and is connected to the control device S by means of signals. In this manner, it is possible to assign recognized flaws on a surface of the strip material B to a specific section of the strip material B, wherein, on the basis of this, it is further possible that the movements of the roller brush(es) 12, specifically both their rotation about the axis of rotation 12 and the associated rotational speed n, along with the specified oscillating movements in the direction of the arrow R1 and in the direction of the arrows R2/R2*, are preferably set in a controlled manner by the control device S as a function of the surface defects and their location and position, which have previously been detected by the surface inspection device(s) 18.

Further details with regard to the composition and arrangement of a roller brush 12 and/or a plurality of them are shown in FIGS. 2*a* to 2*d* and explained as follows:

According to the illustration in FIG. 2*a*, a roller brush 12 can have/be fitted continuously with bristles. In the right-hand region of FIG. 2*a*, a sub-region of the outer circumferential surface of a roller brush 12 is shown in enlarged and greatly simplified form, wherein the dimensions of the bristles are not shown to scale in comparison with the diameter of the roller brush 12. In the enlarged sub-region of FIG. 2*a*, it is shown in simplified form that the bristle ends 13 are slanted, wherein with such embodiment the flattening of the bristle ends 13 extends in the direction of rotation of the roller brush 12.

FIG. 2*b* shows a possible embodiment of a roller brush 12 which is not continuously populated with bristles. This means that, along the longitudinal extension of the roller brush 12, regions 12*m* (with bristles) alternate with regions 12*f* (without bristles).

FIG. 2*c* illustrates the use of roller brushes 12 in the left-hand image region, which are arranged above and below the strip material B and opposite one another, i.e. positioned vertically one above the other.

In the right-hand image region of FIG. 2*c*, a variant is shown with regard to the arrangement of the roller brushes 12, wherein, here, the roller brushes 12 are arranged in a manner offset to one another.

FIG. 2*d* illustrates the use of a plurality of roller brushes, which are designed here in the form of individual brush rollers 12E. It can be provided that such individual brush rollers 12E are not only arranged several times in the width direction of the strip material B, but also—viewed in the strip running direction T-one behind the other. With regard to such individual brush rollers 12E, it is understood that they can in each case be equipped with their own motor drives 14 and their own adjustment/rail systems in order to thereby achieve individually different rotational speeds n, torques Md and oscillating movements in the direction of the arrows R1 and R2/R2*.

FIGS. 1 and 2*d* show an arrangement of the roller brushes with which the axis of rotation is aligned at right angles to the strip running direction T. For the sake of completeness, it is pointed out that a non-rectangular orientation is equally covered by the invention.

With regard to the variants of a roller brush 12 shown in FIG. 2*a* to FIG. 2*d* and explained above, it is understood that such variants can be combined with one another as desired for the device 10 of FIG. 1.

Furthermore, FIG. 3 shows a diagram for controlling the device 10/for carrying out a method.

The invention now functions as follows:

While the strip material B is being moved from the casting machine G in the strip running direction T to the hot rolling line W, it passes through a surface machining by the roller brush 12, with which surface impurities caused by the casting process are mechanically removed. The roller brush 12 is operated with operating parameters preset by the control device S, such as rotational speed n, torque Md, contact pressure and oscillation movements transverse and/or parallel to the transport direction of the strip material. The adjustment of the operating parameters can be effected manually or, as explained separately below, on the basis of a process model and/or can be adjusted automatically by coupling with a surface inspection device.

In the event of the automated adjustment of the operating parameters, the strip material runs past the surface inspection device 18 prior to surface machining. Thereby, surface defects of the strip material B can be detected by the defect detection device(s) of the surface inspection device 18. In other words, during the movement of the strip material B past the surface inspection device 18, possible surface defects of the strip material B are detected by measurement technology. Following this, such surface defects are evaluated by the strip tracking system of the surface inspection device 18 and the information formed from this is passed on to the control device S. On the basis of this, it is then possible to set the operating parameters for the rotating roller brush(es) 12 by means of the control device S, taking into account the measured surface defects, specifically with respect to rotational speed n, torque Md, contact pressure and the oscillating movements transverse ($v_y$) and/or parallel ($v_x$) to the strip running direction T.

In connection with the oscillating movement of the rotating roller brush(es) 12 parallel to the strip running direction T, it is pointed out separately that an individual brush setting/abrasive machining of the strip material B is achieved by the translatory back and forth movement of a roller brush 12: For example, a predetermined section of the strip material B can be brushed shorter or longer, as a function of the surface defects previously detected. Furthermore, it is also possible to realize a dwell time of the rotating roller brush 12 at exactly this section for a predetermined section of the strip material B, by moving the roller brush 12 in the strip running direction T (=direction R2) at exactly the same speed as the strip material B itself. As a result, such predetermined section of the strip material B is machined particularly intensively by means of the rotating roller brush 12.

Furthermore, when the roller brush 12 moves in an oscillating manner parallel to the strip running direction T, it is possible for the forward and return speeds (i.e., in the direction R2 and in the opposite direction R2*) to differ from one another, wherein brushing with the roller brush 12/its rotation takes place in both "directions of travel."

According to a further embodiment of the invention, it is possible to use a process model when setting the operating parameters for the rotating roller brush(es) 12. This is symbolized in the diagram in FIG. 3 by a corresponding arrow between the "process model" and "control device" blocks. The required operating parameters for the rotating roller brush(es) 12 are calculated by means of the process model, or alternatively the calculation in the control device S is supported. In any event, the calculated operating parameters are passed on to the motor drives/actuators that are assigned to a respective roller brush 12.

According to a further embodiment of the method, a control system is provided. Such control system is effected as a function of the measured surface defects, specifically as a function of the location of the defect and/or the size of the defect and/or the periodicity of the defect, wherein the previously described setting parameters of a roller brush 12 are used to set the brushing intensity.

To carry out the control system specified above, it can be provided that the control device S is equipped with a suitable process computer.

According to a further embodiment of the invention, it can be provided that, in the course of evaluating the measured values (i.e., the surface defects that have been detected by the defect detection device), an adaptation calculation is carried out to optimize the control system. The process computer just mentioned can also be used for this purpose.

If a plurality of possibly segmented sub-brushes 12 are provided for the device 10 of FIG. 1, it is understood that an individual/separate control is possible for each of such sub-brushes 12.

If rotating roller brushes 12 are arranged on both sides of the strip material B and thus both the upper side and the lower side of the strip material B are cleaned by this, such roller brushes 12, which are arranged above and below the strip material B, can be controlled/regulated either jointly or individually.

According to a further embodiment of the invention, it is possible for certain specifications with regard to the surface quality (in the sense of target values) of the strip material B to be transmitted to the control device S. This is symbolized in the diagram in FIG. 3 by a dashed arrow between the blocks "surface quality specification" and "control device." In addition or as an alternative to the dependence on the detected surface defects, it is then also possible for the method that the operating parameters for the rotating roller brush(es) 12 are set/regulated by the control device S taking into account such specific specifications for the surface quality. If necessary, this can be effected separately for the upper side and lower side of the strip material B.

Finally, it should be pointed out that it is not always necessary to achieve "totally clean" surfaces for the strip material B produced. For example, for reasons of wear with respect to the rotating roller brush(es) 12, it can make sense to clean the surfaces of the strip material B only to the extent that is actually necessary for such strip material or, as just explained, corresponds to the specific specifications for the surface quality. In such a case, the specifications for the surface quality can be entered into the control device S from a planning system/transmitted to it, wherein such specifications then serve as target values. The control device S will then take these specifications into account appropriately when calculating the operating parameters for the rotating roller brush(es) 12.

LIST OF REFERENCE SIGNS

10 Device
11 Frame
12 Rotating roller brush
12*f* Regions of the roller brush 12 without bristles
12*m* Regions of the roller brush 12 with bristles
12E Individual brush rollers
13 Bristle ends (of a roller brush 12)
14 Motor drive
15 Housing
16 Cleaning device
17 Oscillation drive
18 Surface inspection device
20 Hydraulic cylinder
22 Pump/blower
B Strip material
D Axis of rotation (of a rotating roller brush 12)
R1 Movement of the roller brush 12 transverse to the strip running direction T
R2 Movement of the roller brush 12 parallel to the strip running direction T
G Casting line
S Control device
T Strip running direction
V Connection by means of signals
W Hot rolling line

The invention claimed is:

1. A device (10) for machining at least one surface of a continuous strip material (B) of aluminum or an aluminum alloy, comprising a rotating roller brush (12), a roller length of which can be brought into contact with a surface of the continuous strip material (B), wherein the rotating roller brush (12) has a diameter between 200 mm and 1000 mm, and wherein the device (10) is arranged in a strip casting line downstream of an aluminum casting device (G) for casting the continuous strip material (B) and upstream of an adjoining hot rolling device (W) for rolling the continuous strip material (B).

2. The device (10) according to claim 1, wherein the diameter of the rotating roller brush (12) is between 250 mm and 400 mm.

3. The device (10) according to claim 1, further comprising a motor drive (14) that is operatively connected to the rotating roller brush (12) and drives the rotating roller brush (12) about an associated axis of rotation (D), wherein the motor drive (14) is signal connected to a control device(S) and wherein the control device(S) is programmatically configured in such a manner that the rotating roller brush (12) rotates at a rotational speed of 100 to 3,600 rpm.

4. The device (10) according to claim 3, further comprising a gearbox arranged between the motor drive (14) and the rotating roller brush (12), wherein the rotational speed of the rotating roller brush (12) is between 1,200 and 1,800 rpm.

5. The device (10) according to claim 1, wherein the rotating roller brush (12) is arranged such that it can move back and forth transversely to a strip running direction (T) of the continuous strip material (B).

6. The device (10) according to claim 1, wherein the rotating roller brush (12) is arranged such that it can move back and forth parallel to a strip running direction (T) of the continuous strip material (B).

7. The device (10) according to claim 1, wherein the rotating roller brush (12) is arranged on one side of the continuous strip material (B), wherein a support roller is arranged on an opposite side of and in contact with the continuous strip material (B), and wherein the support roller is in alignment with the roller brush (12).

8. The device (10) according to claim 1, further comprising a cleaning device (16) arranged adjacent to the rotating roller brush (12) and on a same side of the continuous strip material (B) as the rotating roller brush (12), by which the surface of the continuous strip material (B) with which the rotating roller brush (12) is in contact can be cleaned, wherein, by the cleaning device (16), compressed air can be generated adjacent to the surface of the continuous strip material (B), and/or wherein negative pressure can be generated adjacent to the surface of the continuous strip material (B).

9. The device (10) according to claim 8, wherein the cleaning device (16) has a housing (15) with an inlet region and an outlet region, wherein the continuous strip material (B) is movable through the housing (15) from the inlet region towards the outlet region along a strip running direction (T), and wherein the housing (15) is shielded from a surrounding area.

10. The device (10) according to claim 9, wherein the cleaning device (16) and the rotating roller brush (12) are combined to form a structural unit, and wherein the rotating roller brush (12) is received in an encapsulated manner within the housing (15).

11. The device (10) according to claim 1, wherein the rotating roller brush (12) is part of a plurality of rotating roller brushes (12) that are arranged along a strip running direction (T) of the continuous strip material (B) on one side thereof, and wherein the plurality of roller brushes (12) are each equipped with a respective motor drive (14) and a respective height adjustment device (11).

12. The device (10) according to claim 11, wherein two or more of the plurality of rotating roller brushes (12) are arranged one behind the other in the strip running direction (T) of the continuous strip material (B), and wherein the two or more of the plurality of rotating roller brushes (12) are subdivided into segments along their longitudinal extension such that regions including bristles (12*m*) alternate with regions without bristles (12*f*).

13. The device (10) according to claim 11, wherein the rotating roller brush (12) is part of a plurality of individual brush rollers (12E), wherein the plurality of individual brush rollers (12E) are arranged across a width of the continuous strip material (B), and wherein each of the individual brush rollers (12E) has a respective motor drive (14) and can be set independently of one another at a distance from the continuous strip material (B).

14. The device (10) according to claim 1, further comprising a surface inspection device (18), which comprises a strip tracking system with a defect detection device and a control device(S), wherein, by the defect detection device, information relating to a type and position of a surface defect on the surface of the continuous strip material (B) with which the rotating roller brush (12) can be brought into contact is detected, and wherein the rotating roller brush (12) is controlled by the control device(S) based on the information.

15. The device (10) according to claim 1, wherein the rotating roller brush (12) comprises bristles (13) made of hardened stainless steel having a tensile strength of at least 200 $MPa/mm^2$.

* * * * *